US005377699A

United States Patent [19]

Varnum

[11] Patent Number: 5,377,699

[45] Date of Patent: Jan. 3, 1995

[54] HAIR ABRADER

[76] Inventor: Shirley Varnum, 27775 Williams Canyon Rd., Gaston, Oreg. 97119

[21] Appl. No.: 41,472

[22] Filed: Apr. 2, 1993

[51] Int. Cl.[6] ..... A45D 29/18

[52] U.S. Cl. ..... 132/76.4; 132/289; 30/43.5; 606/133

[58] Field of Search ..... 132/76.4, 76.5, 212, 132/289, 292, 333; 606/133, 134; 30/29.5, 43.4, 43.5; 51/170 PT, 271, 332, 334

[56] References Cited

U.S. PATENT DOCUMENTS

| | | | |
|---|---|---|---|
| 2,119,021 | 5/1938 | Moskovics et al. | 30/43.5 |
| 2,311,060 | 2/1943 | Lurrain | 606/133 |
| 2,418,722 | 4/1947 | Page | 30/43.5 |
| 2,440,114 | 4/1948 | Page | 30/43.5 |
| 2,595,693 | 5/1952 | Norwood | 30/43.5 |
| 2,742,694 | 4/1956 | Stone | 30/43.5 |
| 2,839,829 | 6/1958 | Knapp | 30/43.4 |
| 3,027,635 | 4/1962 | Firth | 30/43.5 |
| 3,081,540 | 3/1963 | Yoshida | 30/43.5 |
| 4,180,906 | 1/1980 | May | 30/42 |
| 4,279,253 | 7/1981 | Haes et al. | 132/289 |
| 4,912,845 | 4/1990 | Inoue | 30/43.4 |
| 5,031,318 | 7/1991 | Brown et al. | 30/42 |

FOREIGN PATENT DOCUMENTS

| | | | |
|---|---|---|---|
| 0101656 | 2/1984 | European Pat. Off. | 132/333 |
| 0342546 | 11/1989 | European Pat. Off. | 132/289 |
| 1949521 | 4/1971 | Germany | 132/289 |
| 3740902 | 12/1988 | Germany | 132/76.4 |
| 0115954 | 9/1979 | Japan | 30/43.5 |

*Primary Examiner*—Gene Mancene
*Assistant Examiner*—Frank A. LaViola
*Attorney, Agent, or Firm*—Eugene M. Eckelman

[57] ABSTRACT

There is provided a hair abrading apparatus comprising a driveable member having an abrasive surface to reduce the length and diameter of facial and body hair, and a protective screen or cap to position the hair for contact with the abrasive surface and to protect the skin.

4 Claims, 2 Drawing Sheets

HAIR ABRADER

BACKGROUND OF THE INVENTION

This invention relates to a device for reducing the visibility of body and facial hair for cosmetic purposes.

The most common solution to the problem of excess facial and body hair has been a shaving device or mechanism. The main disadvantage of shaving is that to be effective, it must be done daily and it leaves a stubble, hence it is not generally used by females in facial areas. Various epilation devices such as seen in U.S. Pat. No. 4,279,253 to Haes, Hermes, and Reijnhout (1981) remove the hair by pulling it out. This is a painful process as is an alternate method of removing the hair by electrical current applied to kill the hair itself. Hair has also been removed by applying a mastic which pulls out the hair when the mastic is removed, again resulting in discomfort. Chemical means have also been used either to kill the unwanted hair or to bleach it to reduce visibility but with the disadvantage of causing peripheral damage to the skin and not achieving the desired cosmetic objective of reducing visibility.

SUMMARY OF THE INVENTION

According to the invention and forming a primary objective thereof, a hair abrading, device is provided that abrades and diminishes facial and body hair in diameter and in length.

A more particular object is to abrade the excess hair to a length and diameter that it becomes barely visible.

Another object of the invention is to provide a means of positioning the hair to allow the abrasive material to abrade the hair to desired length and diameter.

Still another object of the invention is to reduce the hair size and visibility in a painless manner, without damaging the skin.

In carrying out these objectives, the apparatus is positioning on the skin surface to allow the hair to enter a screen or perforated cap. This positioning holds the hair in place. An abrasive material is then repeatedly passed across the surface of the unwanted hair, reducing it both in length and diameter. In gradually abrading the hair by repeated contacts with the abrasive material the hair also becomes tapered at the end. Visibility is reduced, and the hair root is left intact. The screen or protective cap also keeps the abrasive material from damaging the skin.

The invention will be better understood and additional objects and advantages will become apparent from the following descriptions taken in connection with the accompanying drawings.

DETAILED DESCRIPTION OF PREFERRED EMBODIMENTS

Figure 1:
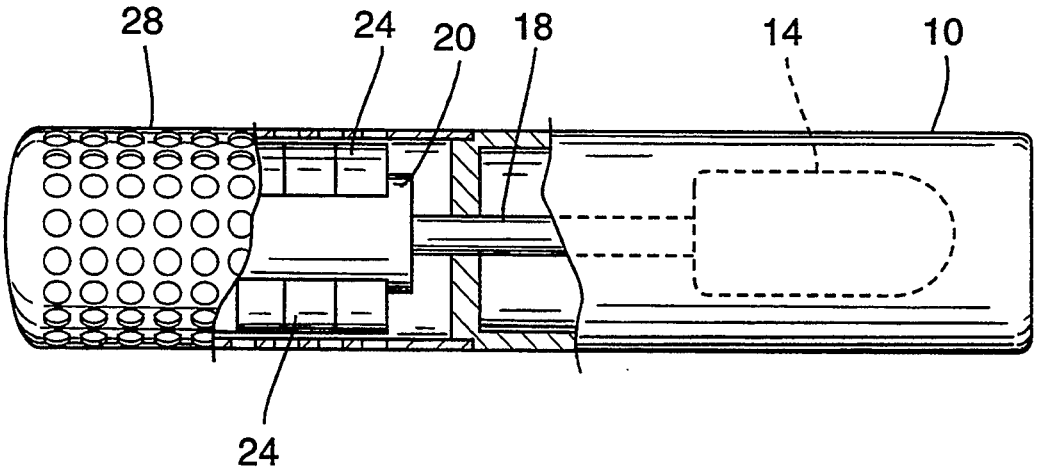
FIG. 1 is a longitudinal elevational view showing a first form of abrading device of the invention, a portion of this view being broken away to show internal structure.
Figure 2:
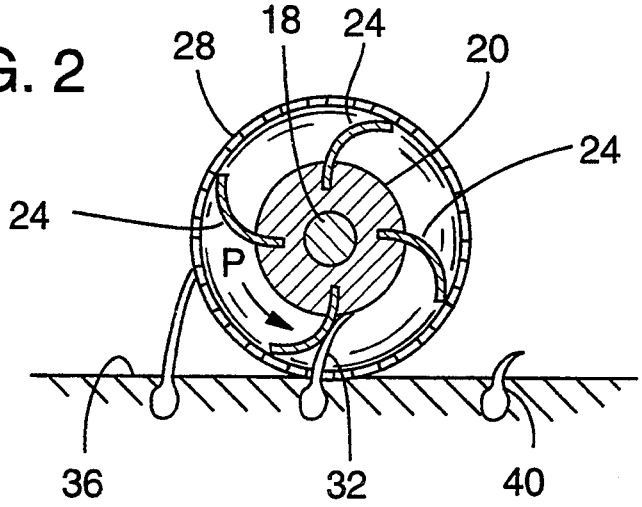
FIG. 2 is an end view of the device of a vertical section FIG. 1 taken through the abrading portion and illustrating schematically a use thereof in relation to skin and hair strands.
Figure 3:
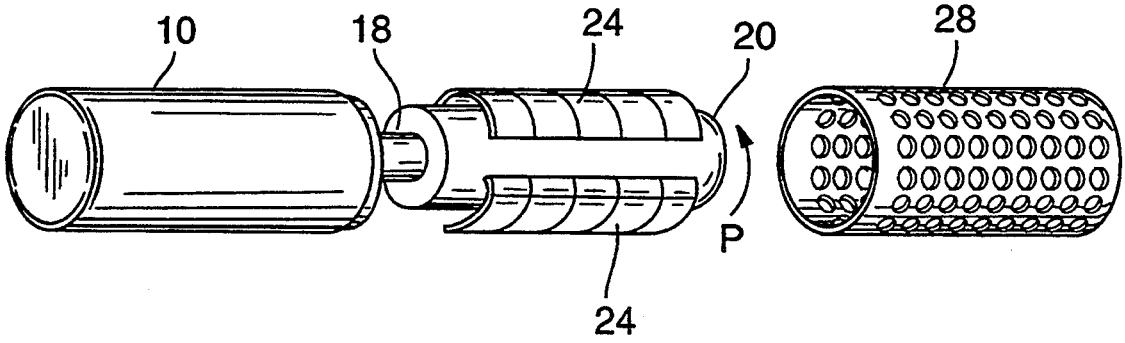
FIG. 3 is an exploded view of the embodiment of FIG. 1.

An abrading apparatus in accordance with FIGS. 1 and 2 comprises a housing 10 which accommodates an electric motor 14 and a shaft 18. Shaft 18 is connected to a replaceable spindle 20 which holds flexible abrasive flaps 24 which are sandpaper or emery cloth. Spindle 20 and flaps 24 are enclosed in a cylindrical screen cap 28 which is perforated to allow entrance of a hair shaft 32 while isolating the skin 36 from the flap 24. Rotation P of flap 24 against hair shaft 32, which is held in place by the perforations in screen cap 28, ultimately wears hair shaft 32 to a shortened and tapered abraded hair 40. Control of the degree of abrasion is governed by the time of contact with the hair shaft.

Figure 4:
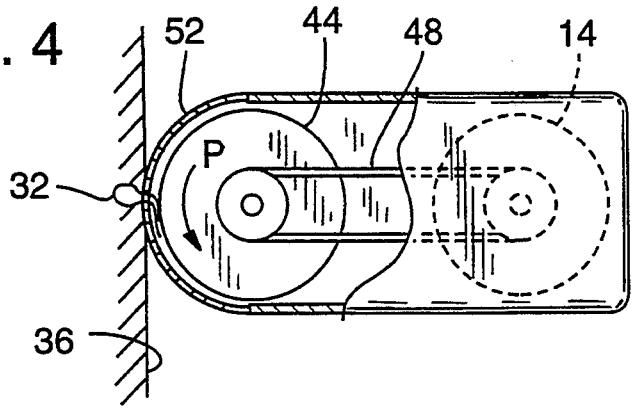
FIG. 4 is a side elevational view of a second embodiment of the invention using a flexible screen as the abrasive surface on a drum a portion of this view being broken away.
Figure 5:
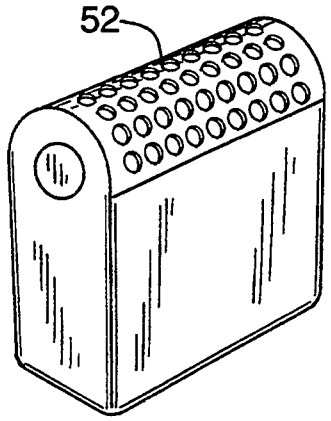
FIG. 5 is a perspective view of the embodiment FIG. 4.

In the embodiment of FIGS. 4 and 5, the abrasive member is a rotating drum 44, which is driven by a belt 48. In this embodiment a protective screen 52 is flexible whereas the abrading drum 44 surface is rigid. Control in the amount of hair abrasion is governed by pressure on flexible screen 52. Pressure reduces the space between screen 52 and drum 44 forcing hair shaft 32 into contact with drum 44, thereby abrading the hair.

Figure 6:
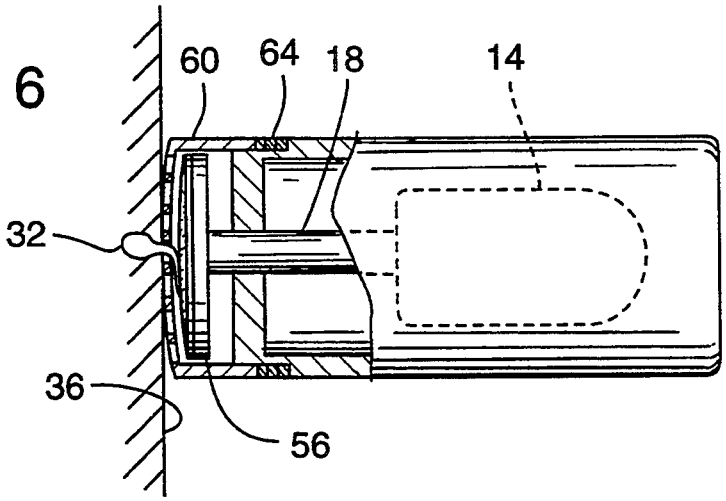
FIG. 6 is a side view, also broken away, of still another embodiment using a flexible orbiting disk in place of the rotating spindle of FIG. 1 and the drum of FIG. 4.
Figure 7:
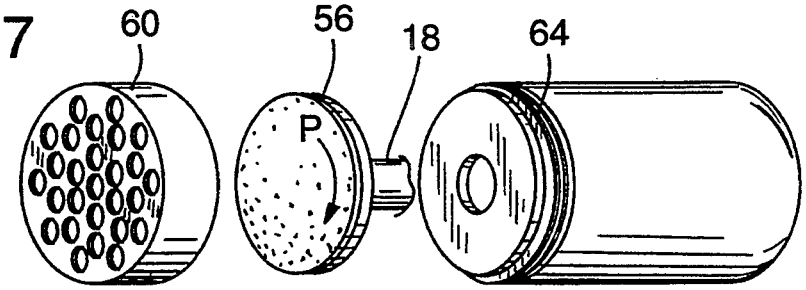
FIG. 7 is an exploded view of the FIG. 6 embodiment.

In still another embodiment of FIGS. 6 and 7, the abrasive member is an orbiting disk 56 and the protective screen is a rigid spring loaded screen cap 60. Control is governed by pressure on the spring loaded screen cap 60. Compression of a spring 64 from this pressure reduces the space between cap 60 and disk 56 and abrades the hair.

Other constructions of the apparatus are within the concept of my invention. For example, the flexible screen cap in FIG. 4 could be replaced with a rigid screen cap that is spring loaded as depicted in FIG. 6.

The material used for the abrasive members is a fine grained grit such as sandpaper or emery cloth for the flexible strips and applications of these abrasives to disks and drums for the embodiments of FIGS. 4 and 6.

In all the embodiments, the operation is basically the same, a wearing away of the hair shaft by abrasive material while protecting the adjacent skin surface. There is no cutting or extraction of hair.

It is to be understood that the form of my invention herein shown and described is to be taken as the preferred example of the same and that various changes in shape, size, and arrangement of the parts may be resorted to without departing from the spirit of the invention or the scope of the subjoined claims.

Having described my invention, I claim:

1. A device for reducing the visibility of body and facial hair from the skin comprising:

a housing, said housing having an exterior skin engaging portion with perforations leading from the exterior to an interior of the housing and said perforations being of a size capable of receiving hair therethrough and holding the hair in projecting relation into said housing, an electric motor in said housing, a head member in said housing driven movably by said motor, and abrasive means on said head member, said head member being positioned in said housing such that said abrasive means in driving movements of said head member pass said perforations in closely spaced relation, said abrasive means, upon repeated engagement of hair projecting through and held by said perforations, taper and gradually wear down the hair to a taper to reduce the diameter and thus the visibility thereof.

2. A device for reducing the visibility of body and facial hair from the skin comprising:

a housing, said housing having an exterior skin engaging portion with perforations leading from an exterior to the interior of the housing and said perforations being of a size capable of receiving hair therethrough, an electric motor in said housing, a head member in said housing driven movably by said motor, and abrasive means on said head member, said abrasive means including abrasive covered flexible flaps on said rotatable head member, said head member being positioned in said housing such that said flaps in driving movements of said head member pass said perforations in closely spaced relation, said flaps upon repeated engagement of hair projecting through said perforations taper and wear down the hair to reduce the visibility thereof.

3. The device of claim 2 wherein said housing comprises a tubular portion with said perforations therein, said head member being cylindrical and operating rotatably on an axis common to said tubular portion, said head member being flexible for varying a spacing thereof relative to said abrasive means by selected pressure of said head member against the skin.

4. The device of claim 3 wherein said head member is spring loaded to achieve said flexibility.

* * * * *